US012209323B2

(12) United States Patent
Piascik et al.

(10) Patent No.: US 12,209,323 B2
(45) Date of Patent: Jan. 28, 2025

(54) ELECTROPLATING SHIELD DEVICE AND METHODS OF FABRICATING THE SAME

(71) Applicant: Honeywell International Inc., Charlotte, NC (US)

(72) Inventors: James Piascik, Randolph, NJ (US); Glenn Sklar, Randolph, NJ (US); Joseph W. Mintzer, III, Phoenix, AZ (US)

(73) Assignee: Honeywell International Inc., Charlotte, NC (US)

( * ) Notice: Subject to any disclaimer, the term of this patent is extended or adjusted under 35 U.S.C. 154(b) by 2 days.

(21) Appl. No.: 17/114,797

(22) Filed: Dec. 8, 2020

(65) Prior Publication Data

US 2022/0178045 A1 Jun. 9, 2022

(51) Int. Cl.
*C25D 17/00* (2006.01)

(52) U.S. Cl.
CPC ..... *C25D 17/008* (2013.01)

(58) Field of Classification Search
None
See application file for complete search history.

(56) References Cited

U.S. PATENT DOCUMENTS

| | | | | |
|---|---|---|---|---|
| 5,098,542 | A * | 3/1992 | Reinhardt | C25D 7/04 204/297.05 |
| 7,943,032 | B2 | 5/2011 | Wurm et al. | |
| 9,260,793 | B2 | 2/2016 | Mayer et al. | |
| 2002/0000372 | A1* | 1/2002 | Pedersen | C25D 17/001 204/279 |
| 2015/0284867 | A1* | 10/2015 | Lorenz | C25D 21/12 205/137 |
| 2016/0169012 | A1 | 6/2016 | DaCunha et al. | |
| 2018/0016688 | A1* | 1/2018 | Angelini | C25D 17/10 |

* cited by examiner

*Primary Examiner* — Louis J Rufo
(74) *Attorney, Agent, or Firm* — Alston & Bird LLP

(57) ABSTRACT

An electroplating device includes a conduit extending from a first end to a second end. The conduit is configured to house an object for electroplating. A first set of apertures is formed on a surface of the conduit. Each of the first set of apertures has a first size. A second set of apertures is formed on the surface of the conduit adjacent the first set of apertures. Each of the second set of apertures has a second size. The first set of apertures are configured to be in alignment with a first continuous section of the object and transfer fluid to the first continuous section of the object at a first rate. The second set of apertures are configured to be in alignment with a second continuous section of the object and transfer fluid to the second continuous section of the object at a second rate.

12 Claims, 6 Drawing Sheets

ELECTROPLATING SHIELD DEVICE AND METHODS OF FABRICATING THE SAME

TECHNICAL FIELD

Various embodiments of the present disclosure relate generally to the field of electroplating and, more particularly, to an electroplating shield device and methods of fabricating the same.

BACKGROUND

Machinery parts are typically electroplated in electroplating solution baths or chambers. Electroplating large machinery parts requires a relatively large spacing (e.g., greater than 4 inches) between the electroplating electrode(s) and the large machinery parts. As such, high volumes of electroplating solutions are required for electroplating large machinery parts. Further, machinery parts with irregular shapes often cause variations in thickness among electroplate coating layers in various areas of the machinery parts (i.e., layers that are coated over various areas of the machinery part via electroplating). Such variations in thickness among electroplate coating layers may result in reduced wear and corrosion resistance. Thus, there is a need for an efficient and cost effective solution to electroplate machinery parts in any shape and/or size with a uniform electroplate coating thickness.

The present disclosure is directed to overcoming one or more of these challenges. The background description provided herein is for the purpose of generally presenting the context of the disclosure. Unless otherwise indicated herein, the materials described in this section are not prior art to the claims in this application and are not admitted to be prior art, or suggestions of the prior art, by inclusion in this section.

SUMMARY OF THE DISCLOSURE

According to certain aspects of the disclosure, an electroplating shield device and methods of fabricating the same for improving electroplating processes are provided in this disclosure.

In one embodiment, an electroplating shield device is disclosed. The electroplating shield device may comprise a conduit extending from a first end to a second end. The conduit may be configured to house an object for electroplating. A first set of apertures may be formed on a surface of the conduit, each of the first set of apertures having a first size. A second set of apertures formed on the surface of the conduit adjacent the first set of apertures, each of the second set of apertures having a second size. The first set of apertures may be configured to i) be in alignment with a first continuous section of the object and ii) transfer fluid to the first continuous section of the object at a first rate. The second set of apertures may be configured to i) be in alignment with a second continuous section of the object and ii) transfer fluid to the second continuous section of the object at a second rate.

In another embodiment, an electroplating shield device is disclosed. The electroplating shield device may comprise a conduit extending from a first end to a second end. A first set of apertures may be formed on a surface of the conduit. The first set of apertures may be configured to i) be in alignment with a first continuous section of an object and ii) transfer fluid to the first continuous section of the object.

In another embodiment, a method of fabricating an electroplating shield device is disclosed. The method may comprise: forming a first set of apertures having a first size on a first region of a strip; forming a second set of apertures having a second size on a second region of the strip adjacent the first region of the strip; and forming a conduit with the strip. The conduit may comprise a first helical section having the first set of apertures and a second helical section having the second set of apertures.

Additional objects and advantages of the disclosed embodiments will be set forth in part in the description that follows, and in part will be apparent from the description, or may be learned by practice of the disclosed embodiments. The objects and advantages of the disclosed embodiments will be realized and attained by means of the elements and combinations particularly pointed out in the appended claims. As will be apparent from the embodiments below, an advantage to the disclosed devices, systems and methods is that machinery parts may be electroplated more efficiently while being wear and corrosion resistant with the electroplating shield device.

It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION OF EMBODIMENTS

Figure 1:
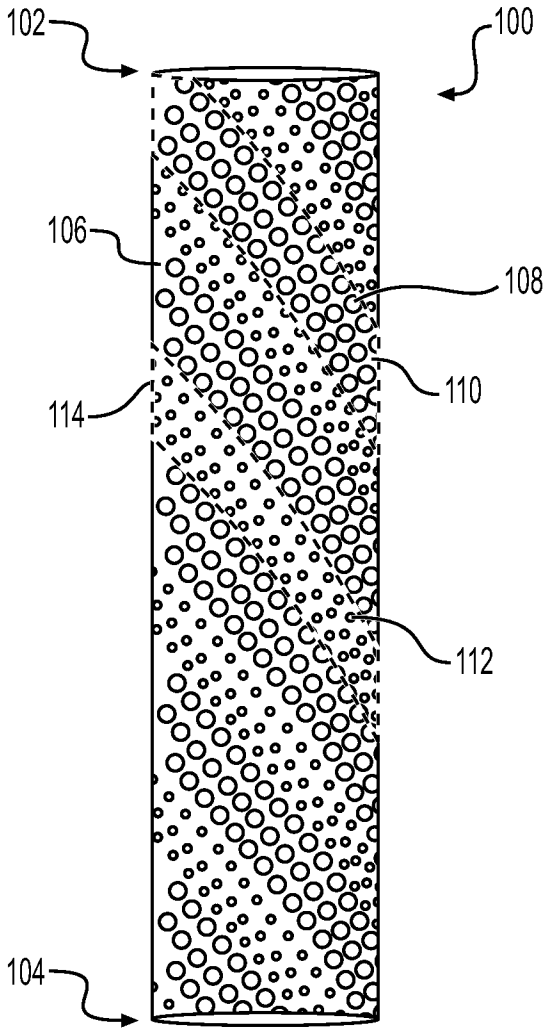
FIG. 1 depicts an example electroplating shield device, according to one or more aspect of the present disclosure.

The following embodiments describe an electroplating shield device and methods of fabricating the electroplating shield device for improving electroplating processes, in accordance with one or more aspects of the present disclosure.

As described above, there is a need in the electroplating technology field to efficiently and uniformly electroplate, for example, machinery parts. For example, electroplating a large machinery part (e.g., a mud motor rotor) having irregular shapes may require at least 4 inches of space between a surface of the large machinery part and one or more electroplating electrodes (e.g., anode electrode(s)). That is, a relatively large electrode spacing may be required in order to produce a suitable electroplate coating layer on the large machinery part. However, such electrode spacing generally requires a large volume of electroplating solution, especially for large machinery parts (e.g., a mud motor rotor) that could extend beyond 30 feet. Minimizing the electrode spacing, in an attempt to reduce the amount of electroplating solution, may result in uneven electroplate coating layers formed on various areas of the large machinery part. Accordingly, the following embodiments describe an electroplating shield device that facilitates application of uniform electroplate coating layers on machinery parts of any shape and/or size.

According to certain aspects of the present disclosure, the electroplating shield device may include a plurality of first openings and a plurality of second openings on the sidewall of the electroplating shield device. The plurality of first openings and the plurality of second openings may be arranged to align with particular areas of a machinery part. For example, the plurality of first openings may be aligned with the minor regions (e.g., concave surfaces of a mud motor rotor) of the machinery part, and the plurality of second openings may be aligned with the major regions (e.g., convex surfaces of a mud motor rotor) of the machinery part. The size of each of the plurality of first openings may be larger than the size of each of the plurality of second openings. The electric field applied between the machinery part and the electroplating electrode may vary based on the size of each of the plurality of first openings and the plurality of second openings. Additionally, the rate of flow of the electroplating solution through the plurality of first openings and the plurality of second openings may also vary based on the size of each of the plurality of first openings and the plurality of second openings. Thus, the amount and/or thickness of electroplate coating layers on the major regions and the minor regions of the machinery part may be controlled and/or applied as desired. Accordingly, a uniform electroplate coating layer may be achieved on machinery parts with any shape and/or size by utilizing the electroplating shield device of the present disclosure.

The subject matter of the present description will now be described more fully hereinafter with reference to the accompanying drawings, which form a part thereof, and which show, by way of illustration, specific exemplary embodiments. An embodiment or implementation described herein as "exemplary" is not to be construed as preferred or advantageous, for example, over other embodiments or implementations; rather, it is intended to reflect or indicate that the embodiment(s) is/are "example" embodiment(s). Subject matter can be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part.

The terminology used below may be interpreted in its broadest reasonable manner, even though it is being used in conjunction with a detailed description of certain specific examples of the present disclosure. Indeed, certain terms may even be emphasized below; however, any terminology intended to be interpreted in any restricted manner will be overtly and specifically defined as such in this Detailed Description section. Both the foregoing general description and the following detailed description are exemplary and explanatory only and are not restrictive of the features, as claimed.

In this disclosure, the term "based on" means "based at least in part on." The singular forms "a," "an," and "the" include plural referents unless the context dictates otherwise. The term "exemplary" is used in the sense of "example" rather than "ideal." The term "or" is meant to be inclusive and means either, any, several, or all of the listed items. The terms "comprises," "comprising," "includes," "including," or other variations thereof, are intended to cover a non-exclusive inclusion such that a process, method, or product that comprises a list of elements does not necessarily include only those elements, but may include other elements not expressly listed or inherent to such a process, method, article, or apparatus. Relative terms, such as, "substantially" and "generally," are used to indicate a possible variation of ±10% of a stated or understood value.

Referring now to the appended drawings, FIG. 1 shows an exemplary electroplating shield device 100, according to one or more aspects of the present disclosure. In one embodiment, the electroplating shield device 100 may include a cylindrical tube (or a conduit) 106. The cylindrical tube 106 may be hollow and substantially straight, extending vertically from a proximal end 102 to a distal end 104. The electroplating shield device 100 may also include a plurality of first openings 108 (e.g., apertures, holes, slots, slits, ovals, perforations, etc.) that penetrate through the sidewall of the cylindrical tube 106. The plurality of first openings 108 may be arranged in a first section 110 on the sidewall of the cylindrical tube 106. The first section 110 of the cylindrical tube 106 may be a continuous, spiral-shaped (or helical) surface that extends vertically from the proximal end 102 to the distal end 104. Additionally, the electroplating shield device 100 may include a plurality of second openings 112 (e.g., apertures, holes, slots, slits, ovals, perforations, etc.) that penetrate through the sidewall of the cylindrical tube 106. The plurality of second openings 112 may be arranged in a second section 114 on the side wall of the cylindrical tube 106. The second section 114 of the cylindrical tube 106 may be a continuous, spiral-shaped (or helical) surface that extends vertically from the proximal end 102 to the distal end 104. The second section 114 may be arranged adjacent to and in between the first section 110. In other words, the continuous, spiral-shaped (or helical) surface of the second section 114 may be arranged adjacent to and alternately in between the continuous, spiral-shaped (or helical) surface of the first section 110, as shown in FIG. 1.

In one embodiment, the size of each of the plurality of first openings 108 may be equal. The size of each of the plurality of second openings 112 may also be equal. In some embodiments, the size of each of the plurality of first openings 108 may be greater than the size of each of the plurality of second openings 112. However, the shape and size of each of the plurality of first openings 108 and the plurality of second openings 112, individually or in groups, may vary based on the shape and dimensions of one or more parts or work pieces (e.g., a shaft, rod, beam, cylinder, bar, etc.) being electroplated. Further, the density and/or number of openings of the plurality of first openings 108 and the plurality of second openings 112 in the first section 110 and the second section 114 may vary based on the shape and dimensions of one or more parts or work pieces. Conventionally, achieving a uniform electroplate coating layer thickness on large machinery parts (e.g., mud motor rotors) with irregular shapes has been difficult. That is, a mud motor rotor, for example, may include major regions (e.g., high/convex regions) that may be coated with electroplating deposits many times thicker than those of minor regions (e.g., low/concave regions). The ratio of electroplating deposit thickness difference between the major regions and the minor regions may be 8:1 or higher depending on the geometry of the mud motor rotor. As such, the difference in the electroplating deposit thicknesses may leave the minor regions with a thinner-than-desired electroplate deposit thickness, which may result in reduced wear and corrosion resistance. Accordingly, the shape and size of each of the plurality of first openings 108 and the plurality of second openings 112 may be varied based on the desired thickness of electroplating deposits on various regions of one or more parts or work pieces. Further, the density of the plurality of first openings 108 and the plurality of second openings 112 in the first section 110 and the second section 114 may also be varied based on the desired thickness of electroplating deposits on various regions of one or more parts or work pieces.

In one embodiment, the cylindrical tube 106 may be made from a material including, for example, titanium or any other suitable materials that have a linear coefficient of thermal expansion (CTE) value (e.g., about 8.4 ppm/° Celsius) substantially similar to the CTE value of a 17-4 Precipitation Hardening grade (17-4PH) alloy or a 4140 alloy. The following table shows a list of suitable metals that may be used to fabricate the cylindrical tube 106.

| Metal | CTE (ppm/° C.) | CTE Temperature Range (° C.) |
|---|---|---|
| Titanium | 8.4 | 20-68 |
| 17-4ph Stainless | 10.8 | 21-93 |
| Hatelloy c276 Superalloy | 11.2 | 24-100 |
| Inconel 718 Superalloy | 12.8 | 21-93 |
| 304 Stainless | 17.3 | 20 C. |
| 440C Stainless | 10.1 | 0-100 |
| 4140 Steel | 12.2 | 0-100 |

For example, a suitable metal for fabricating the cylindrical tube 106 may be selected based at least on one or more the following attributes: light weight; high strength; corrosion resistance; matching coefficient of thermal expansion to the one or more parts or work pieces (e.g., mud motor rotors); cost; and ease or difficulty of fabrication.

Plastic electroplating shields (e.g., polyethylene (PE), chlorinated polyvinyl chloride (CPVC), polyvinyl chloride (PVC), etc.), for example, may have a CTE value (e.g., about 79 ppm/° Celsius) that is 7 times or higher than the CTE value of a 17-4PH alloy. As such, plastic electroplating shields may undergo dimensional distortions in hot (e.g., about 70° Celsius or greater) electroplating baths, particularly for plastic shields for large, long machinery parts such as mud motor rotors. However, the cylindrical tube 106 made from high strength titanium, or any other suitable materials described above, may yield a thin and lightweight construction for the electroplating shield device 100 that undergoes relatively low dimensional distortions (e.g., about 0.029 inches of relative growth per 20 feet length over about 50° Celsius temperature range) in hot electroplating baths. The cylindrical tube 106 made from titanium or other suitable materials having a lightweight construction improves mobility and efficiency during electroplating processes, especially for electroplating large machinery parts (e.g., length greater than 20 feet) such as mud motor rotors. Further, the thin sidewall of the cylindrical tube 106 may displace less electroplating solution and promote efficient electroplating solution movement as compared to thicker plastic shields. Accordingly, the cylindrical tube 106 made of titanium or other suitable materials may allow tighter electrode spacing, for example, in relatively smaller, enclosed electroplating chambers. The thin sidewalls of the cylindrical tube 106 may also yield openings (the plurality of first openings 108 and the plurality of second openings 112) with low aspect ratios, which may facilitate improved electroplating solution movement through the electroplating shield device 100. In one embodiment, masks may be applied to the cylindrical tube 106 to improve corrosion resistance. The masks may include, for example, PVC, epoxy, and fluoropolymers (e.g., polytetrafluoroethylene (PTFE), ethlyne tetrafluoroethylene (ETFE), fluorinated ethylene propylene (FEP), perfluoroalkoxy alkane (PFA), etc.).

Figure 2:
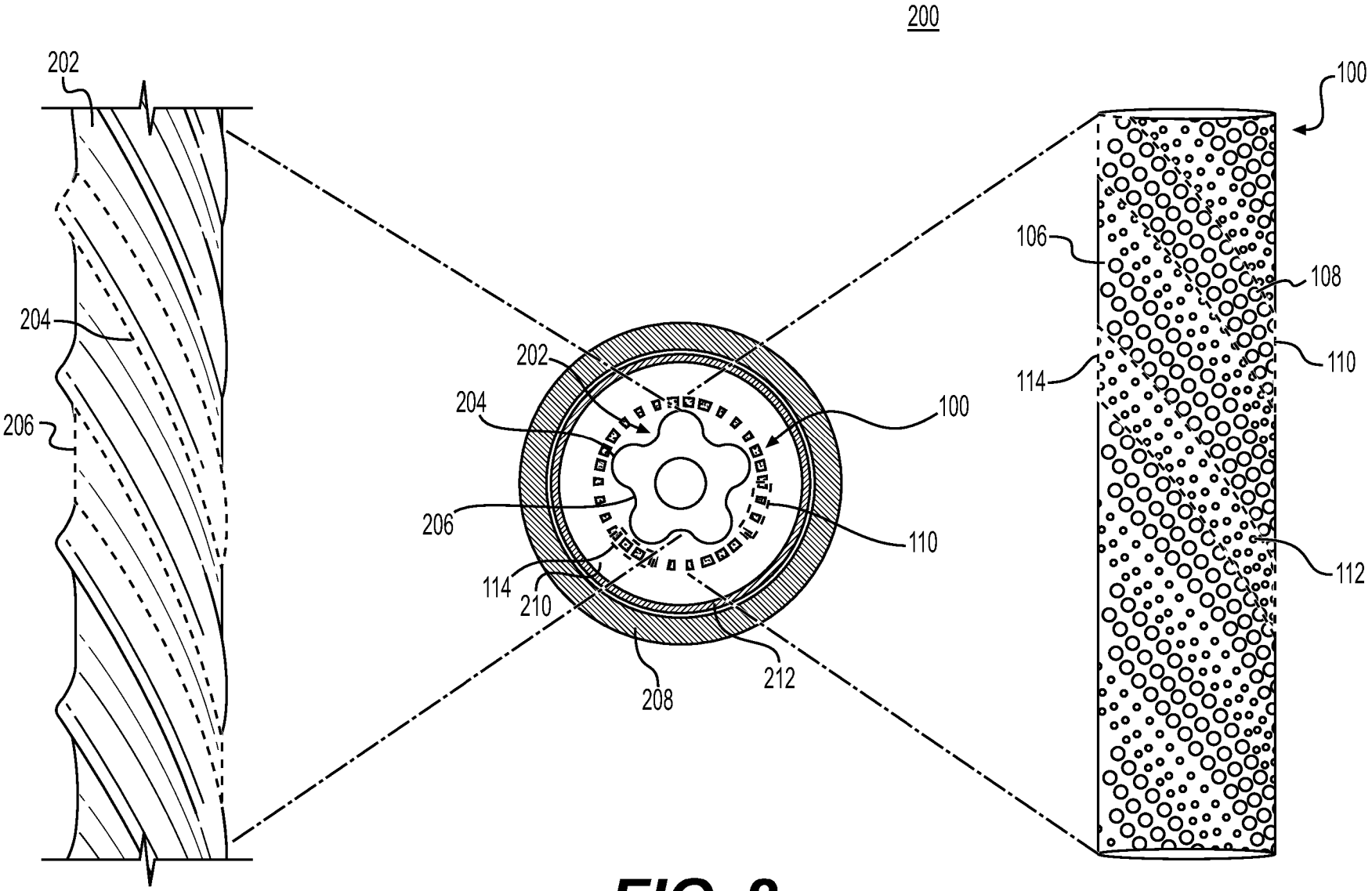
FIG. 2 depicts an example electroplating system, according to one or more aspects of the present disclosure.

FIG. 2 depicts an example electroplating system 200, according to one or more aspects of the present disclosure. The electroplating system 200 may include an electroplating chamber 208. The electroplating chamber 208 may be an open electroplating chamber (or bath) or an enclosed electroplating chamber that is configured to receive and store one or more parts 202 (e.g., a shaft, rod, beam, cylinder, bar, etc.). An enclosed electroplating chamber may receive the one or more parts 202 via one or more openings on the enclosed electroplating chamber. An enclosed chamber may include one or more covers that are configured to open and close the one or more openings of the enclosed electroplating chamber. The electroplating chamber 208 may contain one or more electroplating solutions 210, one or more anode electrodes 212 and one or more cathode electrodes (only anode electrode 212 shown in FIG. 2 for clarity). The one or more anode electrodes 212 and the cathode electrodes may to apply electric current and electric fields in the electroplating chamber 208 to facilitate the application of electroplating coating layers on the one or more parts 202.

In one embodiment, the electroplating chamber 208 may be configured to receive and store the part 202 and the electroplating shield device 100. The length of the electroplating chamber 208 may be greater than the part 202 and the electroplating shield device 100. The electroplating chamber 208 may be greater than 20 feet, for example, to receive and store large machinery parts (e.g., a rotor of positive-displacement motors, progressive cavity pumps, etc.). However, of course, the electroplating chamber 208 may be designed to be any length suitable for various other applications. Further, the electroplating chamber 208 may be configured to receive the one or more electroplating solutions 210 from a reservoir system via one or more conduits (not shown in the figures), in order to facilitate the electroplating process of the present disclosure. Additionally, the electroplating chamber 208 may be connected a controller system. The controller system may automatically or manually facilitate the electroplating processes of the present disclosure by providing the electroplating solutions 210 and electric current to the electroplating chamber 208 via pumps, actuators, electrodes, and/or valves that are coupled to the electroplating chamber 208 and the reservoir system.

Still referring to FIG. 2, the part 202 may be greater than 30 feet, for example, and may include major regions 204 and minor regions 206. The major regions 204 may include one or more protruding, spiral-shaped lobes (or convex surface) that vertically extend from one end to the opposite end of the part 202. The minor regions 206 may include spiral-shaped depressions (or concave surface) that vertically extend from one end to the opposite end of the part 202. The minor regions 206 may be arranged adjacent to and in between the major regions 204. In other words, the continuous, spiral-shaped depressions of the minor regions 206 may be arranged adjacent to and alternately in between the continuous, spiral-shaped lobes of the major regions 204, as shown in FIG. 2.

In one embodiment, the part 202 may be placed into the electroplating chamber 208, and the electroplating shield device 100 may be placed in between the part 202 and the anode electrode 212. In this embodiment, the length of the electroplating shield device 100 may be equal to or greater than the length of the part 202, so as to arrange or place the entire piece of the part 202 within the electroplating shield device 100. Further, the electroplating shield device 100 may be arranged or placed relative to the part 202, so as to align the first section 110 of the electroplating shield device 100 with the minor regions 206 of the part 202 and the second section 114 of the electroplating shield device 100 with the major regions 204 of the part 202. In one embodiment, the size of the plurality of first openings 108 arranged in the first section 110 may be greater than the size of the plurality of second openings 112 arranged in the second section 114. As such, during an electroplating process of the present disclosure, one or more electroplating solutions may flow through the plurality of first openings 108 at a greater rate than through the plurality of second openings 112. Further, a greater electric field may be applied to the minor regions 206 through the plurality of first openings 108 than the major regions 204 through the plurality of second openings 112. Accordingly, despite the minor regions 206 of the part 202 being located at a greater distance from the anode electrode 212 than the major regions 204, an electroplate coating layer may be deposited on both the minor regions 206 and the major regions 204 of the part 202 with a uniform thickness. The size of each, and the density the openings, of the plurality of first openings 108 and the plurality of second openings 112 may be varied depending on the shape, size, and/or dimensions of the part 202. Further, the size of each, and the density of the openings, of the plurality of first opening 108 and the plurality of second openings 112 may be varied based on the distance between the anode electrode 212 and the surfaces of different regions (e.g., major regions 204 and minor regions 206) of the part 202. In one embodiment, the electrode spacing between the anode electrode 212 and the part 202 may be 1 inch or less.

Figure 3:
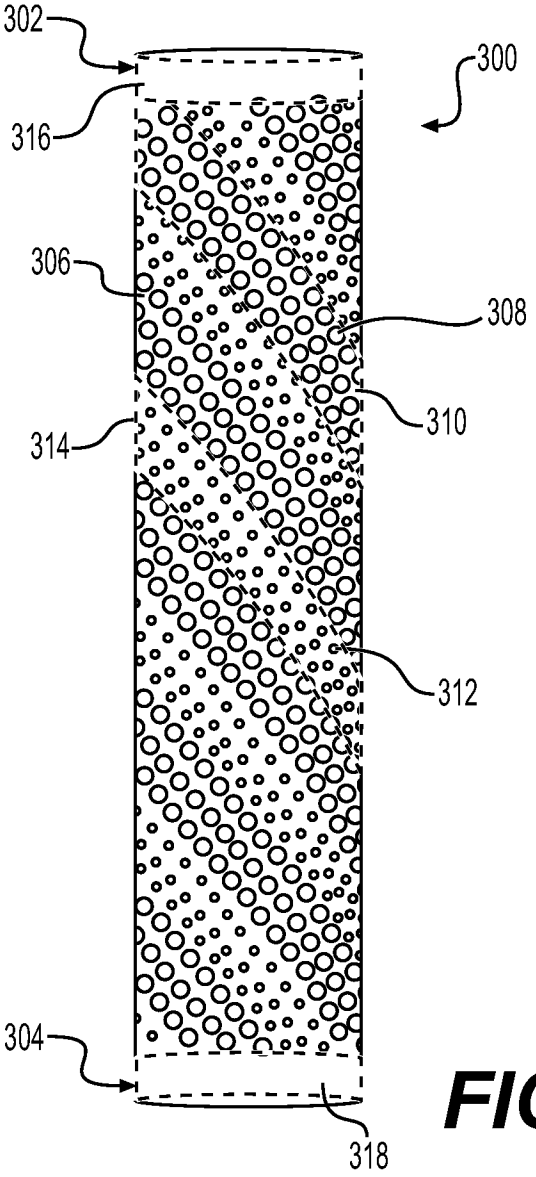
FIG. 3 depicts another example electroplating shield device, according to one or more aspect of the present disclosure.

FIG. 3 shows another example electroplating shield device 300, according to one or more aspects of the present disclosure. In one embodiment, the electroplating shield device 300 may include a cylindrical tube 306. The cylindrical tube 306 may be hollow and substantially straight, extending vertically from a proximal end 302 to a distal end 304. The electroplating shield device 300 may include a plurality of first openings 308 (e.g., apertures, holes, slots, slits, ovals, perforations, etc.) that penetrate through the sidewall of the cylindrical tube 306. The plurality of first openings 308 may be arranged in a first section 310 of the cylindrical tube 306. The first section 310 of the cylindrical tube 306 may be a continuous, spiral-shaped (or helical) surface that extends vertically from the proximal end 302 to the distal end 304. Additionally, the electroplating shield device 300 may include a plurality of second openings 312 (e.g., apertures, holes, slots, slits, ovals, perforations, etc.) that penetrate through the sidewall of the cylindrical tube 306. The plurality of second openings 312 may be arranged in a second section 314 of the cylindrical tube 306. The second section 314 of the cylindrical tube 306 may be a continuous, spiral-shaped (or helical) surface that extends vertically from the proximal end 302 to the distal end 304. The second section 314 may be arranged adjacent to and in between the first section 310. In other words, the continuous, spiral-shaped (or helical) surface of the second section 314 may be arranged adjacent to and alternately in between the continuous, spiral-shaped (or helical) surface of the first section 310, as shown in FIG. 3.

Still referring to FIG. 3, the electroplating shield device 300 may include a first zone 316 and a second zone 318 on the cylindrical tube 306. The first zone 316 may include a continuous, cylindrical surface between the proximal end 302 and the plurality of first openings 308 and the plurality of second openings 312. The first zone 316 may include a solid surface that may not include any openings (e.g., a non-perforated zone). The second zone 318 may include a continuous, cylindrical surface between the distal end 304 and the plurality of first openings 308 and the plurality of second openings 312. The second zone 318 may also include a solid surface that may not include any openings (e.g., a non-perforated zone).

In some embodiments, the opposing ends of the part 202 (i.e., the proximal end 302 and the distal end 304) may experience a higher electroplating rate compared to the rest of the part 202. For example, about 6 inches in vertical length at each end of the part 202 may gain a thicker growth of electroplate coating layer compared to the rest of the part 202. Accordingly, the electroplating shield device 300 may include the first zone 316 and the second zone 318 with a vertical length that may be equal to or greater than about 6 inches. In some embodiments, the size and length of the first zone 316 and the second zone 318 may be varied based on the amount of electroplate coating layer growth on each end of one or more parts being electroplated. Further, the electroplating shield device 300 may be arranged or placed within the an electroplating chamber (e.g., the electroplating chamber 208) in the manner to cover at least about 6 inches of each end of the part 202 with the first zone 316 and the second zone 318. Accordingly, a uniform electroplate coating layer may be formed on the part 202 by utilizing the electroplating shield device 300, in accordance with one or more aspects of the present disclosure.

Figure 4:
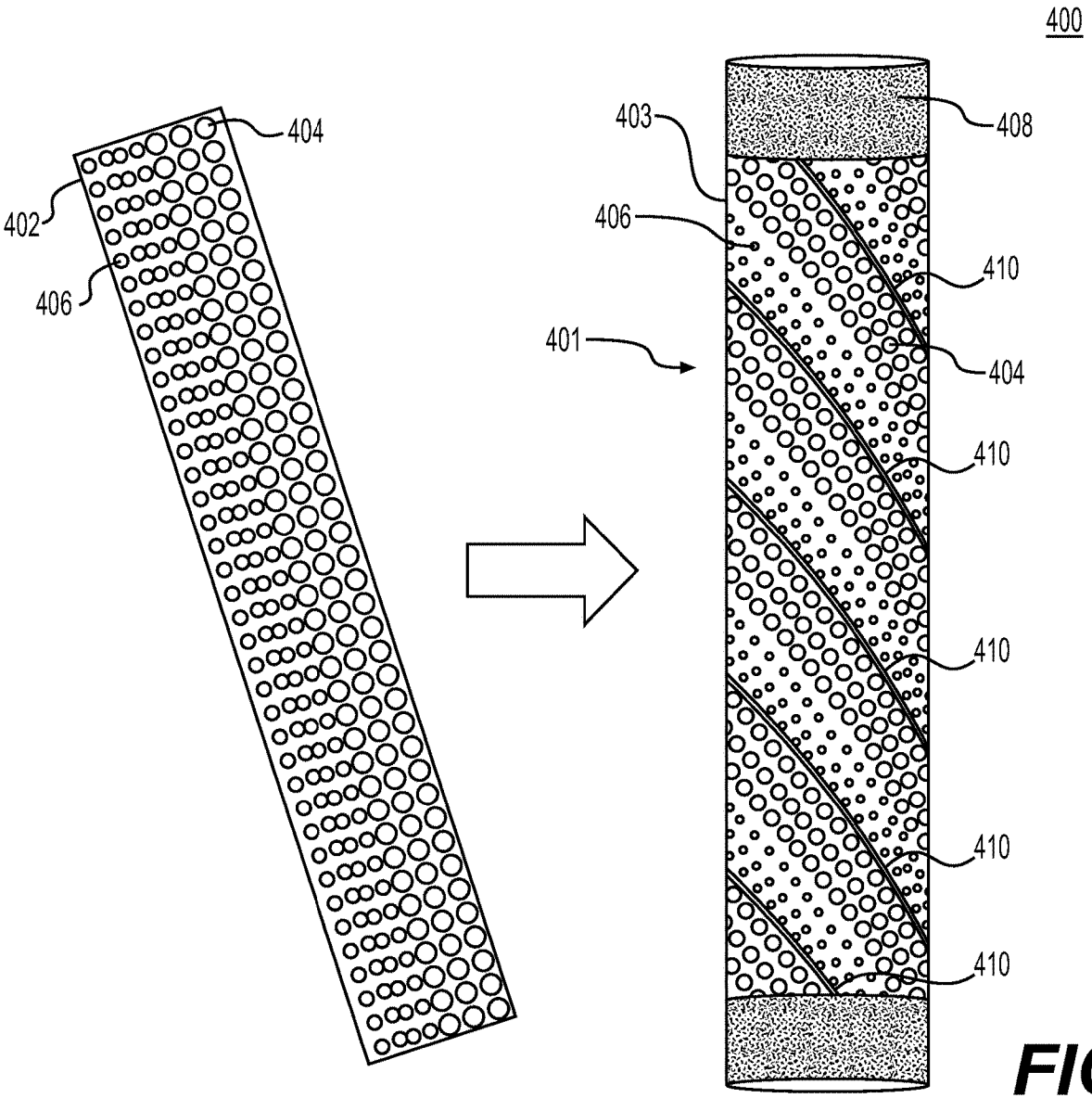
FIG. 4 depicts an example process for fabricating an electroplating shield device, according to one or more aspects of the present disclosure.

FIG. 4 shows an exemplary process 400 for fabricating an electroplating shield device 401, according to one or more aspects of the present disclosure. In one embodiment, a strip 402 having a plurality of first openings 404 (e.g., apertures, holes, slots, slits, ovals, perforations, etc.) and a plurality of second openings 406 (e.g., apertures, holes, slots, slits, ovals, perforations, etc.) may be provided. In one embodiment, the plurality of first openings 404 may be provided on a first half of the strip 402, and the plurality of the second openings 406 may be provided on a second half of the strip 402, as shown in FIG. 4. The plurality of first openings 404 and the plurality of second openings 406 may be machined, punched, drilled, photoetched and/or laser cut by utilizing a suitable manual or automated equipment/device. The strip 402 may be made from, for example, titanium or other suitable materials that have a coefficient of thermal expansion (CTE) substantially similar to the CTE of a 17-4 Precipitation Hardening grade (17-4PH) alloy or a 4140 alloy.

Still referring to FIG. 4, the strip 402 may be formed into a cylindrical-shaped tube 403 by helically winding the strip 402 around a mandrel 408 (e.g., a column, a rod, a cylinder, a pillar, etc.). The strip 402 may be wound around the mandrel 408 to align the plurality of first openings 404 and the plurality of the second openings 406 with the minor regions 206 and the major regions 204 of the part 202. In one embodiment, the strip 402 may be welded at a continuous, helical gap (or seam) 410. In one embodiment, the electroplating shield device 401 may be tack welded at various sections of the continuous, helical gap 410 to confine and hold the dimensions of the electroplating shield device 401. Any suitable welding device (or equipment) may be used to manually or automatically weld the continuous, helical gap 410.

Figure 5:
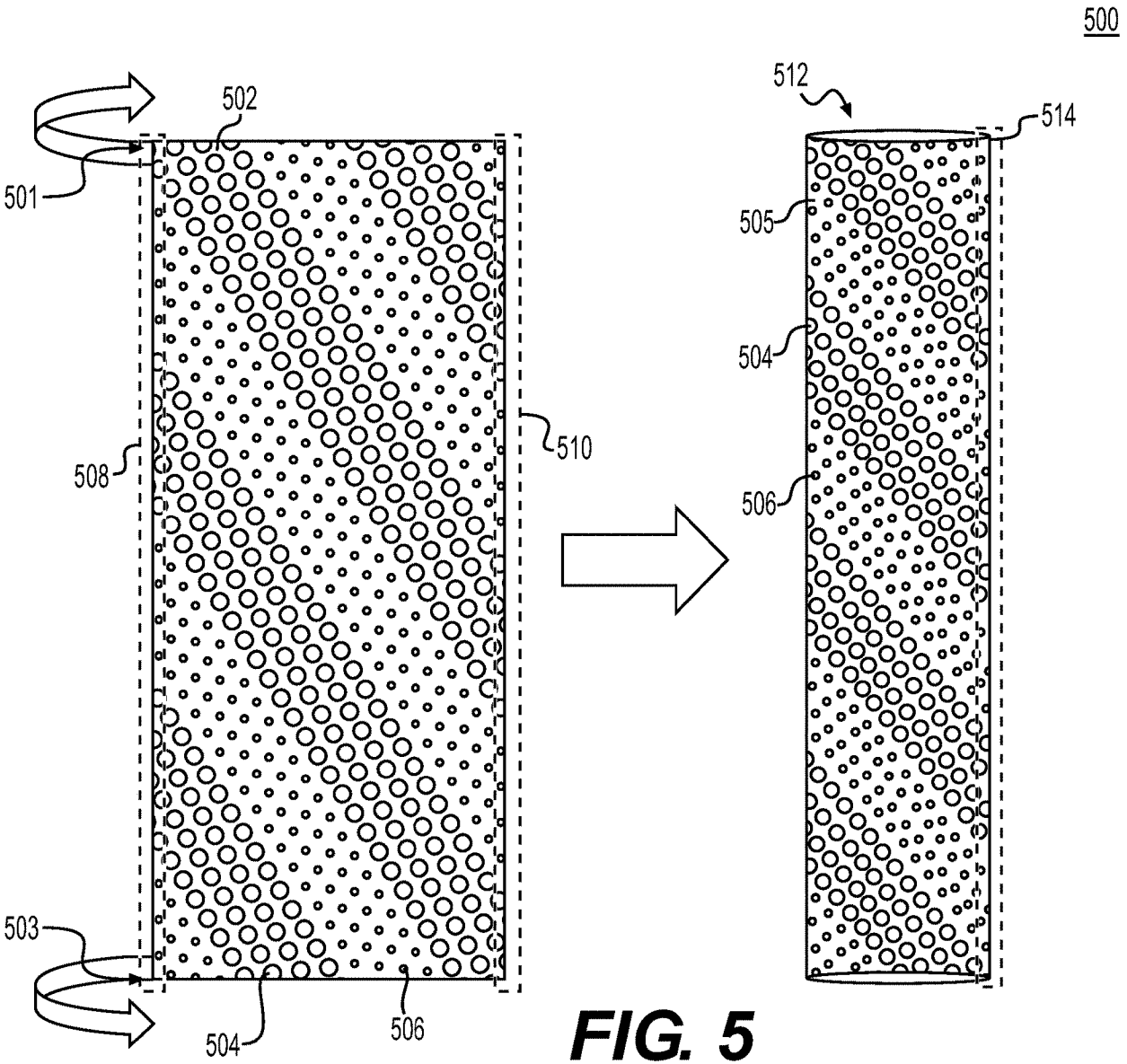
FIG. 5 depicts another example process for fabricating an electroplating shield device, according to one or more aspects of the present disclosure.

FIG. 5 shows another exemplary process 500 for fabricating an electroplating shield device 512, according to one or more aspects of the present disclosure. In one embodiment, a strip 502 having a plurality of first openings 504 (e.g., apertures, holes, slots, perforations, etc.) and a plurality of second openings 506 (e.g., apertures, holes, slots, perforations, etc.) may be provided. In one embodiment, the plurality of first openings 504 and the plurality of second openings 506 may be provided diagonally, extending from a proximal end 501 to a distal end 503. The first plurality of openings 504 and the second plurality of openings 506 may be provided alternately in different diagonal sections of the strip 502, as shown in FIG. 5. The plurality of first openings 404 and the plurality of second openings 406 may be machined, punched, drilled, photoetched and/or laser cut by utilizing suitable automated equipment. The strip 402 may be made from, for example, titanium or other suitable materials that have a coefficient of thermal expansion (CTE) substantially similar the CTE of a 17-4 Precipitation Hardening grade (17-4PH) alloy or a 4140 alloy.

Still referring to FIG. 5, the strip 502 may be formed into a cylindrical-shaped tube 505 by rolling the strip 502 into a cylindrical shape by vertically joining a first section 508 with a second section 510. The plurality of first openings 504 and the plurality of the second openings 506 may be provided on the strip 502 such that the plurality of the first openings 504 and the plurality of second openings 506, once the strip 502 has been rolled into the cylindrical shape, are provided as alternating continuous, helical sections extending vertically from one end to the other end of the cylindrical-shaped tube 505, as shown in FIG. 5. The strip 502 may then be welded at a third section 514, where the first section 508 and the second section 510 meet to form the cylindrical-shaped tube 505. In one embodiment, the electroplating shield device 512 may be tack welded at various locations of the third section 514 to confine and hold the dimensions of the electroplating shield device 512. Any suitable welding device (or equipment) may be used to manually or automatically weld the third section 514 where the first section 508 and the second section 510 meet. Alternatively or additionally, the strip 502 may include a first solid surface zone adjacent to the proximal end 501 and a second solid surface zone adjacent to the distal end 503. The first and second solid surface zones may not include the plurality of first openings 504 and the plurality of second openings 506. In one embodiment, the first and second solid surface zones may be at least 6 inches in vertical length. The first and second solid surface zones may be provided on the strip 502 such that when the strip 502 is rolled into a cylindrical shape by vertically joining the first section 508 with the second section 510, the electroplating shield device 512 may include the first solid surface zone and the second solid surface zone similarly to the first zone 316 and the second zone 318 on the cylindrical tube 306, as shown in FIG. 3.

Figure 6:
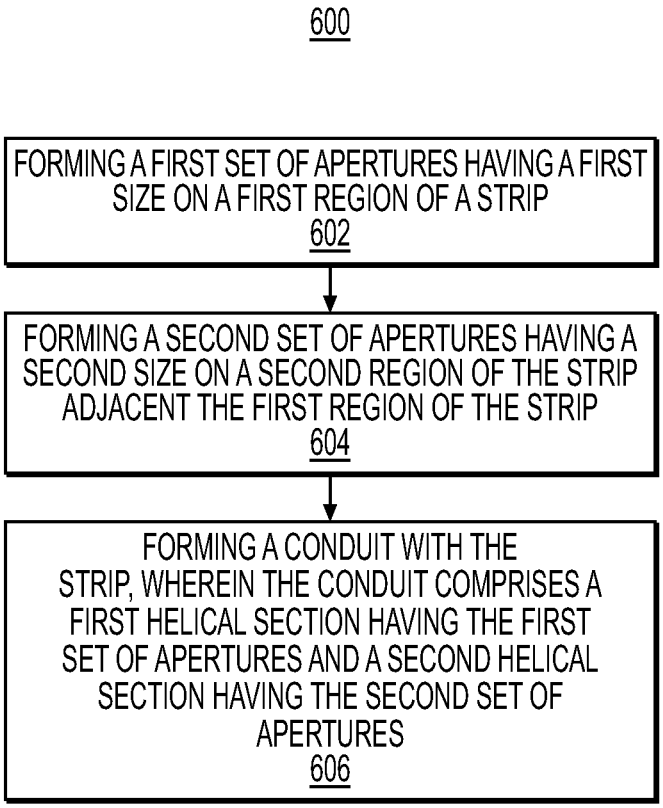
FIG. 6 depicts a flowchart of an example method for fabricating an electroplating shield device, according to one or more aspects of the present disclosure.

FIG. 6 depicts a flowchart of an exemplary method 600 for fabricating an electroplating shield device, in accordance with one or more aspects of the present disclosure. At step 602, a fabrication system of the present disclosure may form a first set of apertures having a first size on a first region of a strip. The strip may be formed of titanium. Additionally or alternatively, the strip may be formed of a material having a linear coefficient of thermal expansion lower than 79.0 ppm/° C.

At step 604, the fabrication system may form a second set of apertures having a second size on a second region of the strip adjacent the first region of the strip. In one embodiment, the first size of each of the first set of apertures and the second size of each of the second set of apertures may be different. The first set of apertures and the second set of apertures may be formed with at least one of a drill, a punch device, a photoetching device, a laser device, and/or a computer numerical control device.

Still referring to FIG. 6, at step 606, the fabrication system may form a conduit with the strip. The conduit may comprise a first helical section having the first set of apertures and a second helical section having the second set of apertures. In one embodiment, the conduit may be formed by helically winding the strip around a pillar as described above in reference to FIG. 4. The fabrication system may then weld a continuous gap formed between the first helical section and the second helical section. In another embodiment, the conduit may be formed by rolling the strip and bringing a first vertical side of the strip to a second vertical side of the strip as described above in reference to FIG. 5. The fabrication system may then weld a continuous gap formed between the first vertical side of the strip and the second vertical side of the strip. Further, the strip may comprise a first section proximate to a first end (e.g., a proximal end 302 in FIG. 3), and a second section proximate a second end (e.g., a distal end 304 in FIG. 3). The first section and the second section may each comprise a solid surface without apertures as described above in reference to FIG. 3.

It should be appreciated that in the above description of exemplary embodiments, various features are sometimes grouped together in a single embodiment, figure, or description thereof for the purpose of streamlining the disclosure and aiding in the understanding of one or more of the various aspects. This method of disclosure, however, is not to be interpreted as reflecting an intention that the claimed embodiment requires more features than are expressly recited in each claim. Thus, the claims following the Detailed Description are hereby expressly incorporated into this Detailed Description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those skilled in the art. For example, in the following claims, any of the claimed embodiments can be used in any combination.

Thus, while certain embodiments have been described, those skilled in the art will recognize that other and further modifications may be made thereto without departing from the spirit of the disclosure, and it is intended to claim all such changes and modifications as falling within the scope of the disclosure. For example, functionality may be added or deleted from the block diagrams and operations may be interchanged among functional blocks. Steps may be added or deleted to methods described within the scope of the present disclosure.

The above disclosed subject matter is to be considered illustrative, and not restrictive, and the appended claims are intended to cover all such modifications, enhancements, and other implementations, which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description. While various implementations of the disclosure have been described, it will be apparent to those of ordinary skill in the art that many more implementations and implementations are possible within the scope of the disclosure. Accordingly, the disclosure is not to be restricted.

What is claimed is:

1. An electroplating shield device comprising:

a conduit consisting of titanium and that is free from a corrosion-resistant mask extending from a first end to a second end, the conduit being configured to house an object for electroplating within a hollow interior portion defined by a sidewall of the conduit;

a first set of apertures formed on a surface of the conduit, each of the first set of apertures having a first size based on a shape and a dimension of the object for electroplating; and a second set of apertures formed on the surface of the conduit adjacent the first set of apertures, each of the second set of apertures having a second size based on the shape and the dimension of the object for electroplating, wherein the first set of apertures form a first continuous helical section on the surface of the conduit, and the second set of apertures form a second continuous helical section on the surface of the conduit, wherein the first continuous helical section and the second continuous helical section of the surface each extends between the first end and the second end of the conduit, wherein the first set of apertures are configured to transfer fluid to a first continuous section of the object at a first rate, wherein the second set of apertures are configured to transfer fluid to a second continuous section of the object at a second rate, and wherein each of the first set of apertures and the second set of apertures is defined by an orifice that provides a respective fluid connection between an external environment outside of the sidewall of the conduit and the hollow interior portion.

2. The electroplating shield device of claim 1, wherein the first size of the first set of apertures is larger than the second size of the second set of apertures.

3. The electroplating shield device of claim 1, wherein the first rate is greater than the second rate.

4. The electroplating shield device of claim 1, wherein the conduit comprises:

a first section proximate to the first end, the first section comprising a first cylindrical surface; and a second section proximate to the second end, the second section comprising a second cylindrical surface, wherein the first set of apertures and the second set of apertures do not extend to the first section and the second section.

5. The electroplating shield device of claim 4, wherein a length of the first section and a length of the second section are at least 6 inches.

6. The electroplating shield device of claim 1, wherein the first continuous section of the object comprises a minor of the object and the second continuous section of the object comprises a major of the object.

7. The electroplating shield device of claim 1, wherein the first set of apertures further form a third continuous helical section on the surface of the conduit, wherein the second continuous helical section is arranged adjacent to and in between the first continuous helical section and the third continuous helical section defined by the first set of apertures.

8. The electroplating shield device of claim 7, wherein the second set of apertures further form a fourth continuous helical section on the surface of the conduit, wherein the fourth continuous helical section is arranged adjacent the third continuous helical section defined by the first set of apertures such that the first set of apertures and the second set of apertures are arranged alternately relative to one another.

9. An electroplating shield device comprising:

a conduit extending from a first end to a second end, the conduit being configured to house an object for electroplating within a hollow interior portion defined by a sidewall of the conduit; and a first set of apertures formed on a surface of the conduit, the first set of apertures based on a shape and a dimension of an object for electroplating, wherein the first set of apertures are configured to i) be in alignment with a first continuous section of an object and ii) transfer fluid to the first continuous section of the object, wherein the conduit consists of titanium and is free from a corrosion-resistant mask for improving corrosion resistance or wherein the conduit is made from a non-titanium metal that has a linear coefficient of thermal expansion (CTE) value substantially similar to the CTE value of a 17-4 Precipitation Hardening grade (17-4PH) alloy or a 4140 alloy, wherein each of the first set of apertures is defined by an orifice that provides a respective fluid connection between an external environment outside of the sidewall of the conduit and the hollow interior portion, and wherein the first set of apertures form a first continuous helical section on the surface of the conduit, and wherein the first continuous helical section of the surface extends between the first end and the second end of the conduit.

10. The electroplating shield device of claim 9, further comprising:

a second set of apertures formed on a surface of the conduit, wherein the second set of apertures are configured to transfer fluid to the second continuous section of the object, wherein the second set of apertures form a second continuous helical section on the surface of the conduit, wherein the second continuous helical section of the surface extends between the first end and the second end of the conduit.

11. The electroplating shield device of claim 10, wherein the first set of apertures further form a third continuous helical section on the surface of the conduit, wherein the second continuous helical section is arranged adjacent to and in between the first continuous helical section and the third continuous helical section defined by the first set of apertures.

12. The electroplating shield device of claim 11, wherein the second set of apertures further form a fourth continuous helical section on the surface of the conduit, wherein the fourth continuous helical section is arranged adjacent the third continuous helical section defined by the first set of apertures such that the first set of apertures and the second set of apertures are arranged alternately relative to one another.

* * * * *